US005430440A

United States Patent [19]

Shim

[11] Patent Number: 5,430,440

[45] Date of Patent: Jul. 4, 1995

[54] URGENT CALL DISPLAYING METHOD FOR A RADIO PAGING RECEIVER

[75] Inventor: Jong-Yoon Shim, Suwon, Rep. of Korea

[73] Assignee: SamSung Electronics Co., Ltd., Suwon, Rep. of Korea

[21] Appl. No.: 106,753

[22] Filed: Aug. 16, 1993

[30] Foreign Application Priority Data

Nov. 19, 1992 [KR] Rep. of Korea ..... 21783/1992

[51] Int. Cl.[6] ..... G08B 5/22

[52] U.S. Cl. ..... 340/825.44; 340/825.47

[58] Field of Search ..... 340/825.44, 825.47; 455/38.1, 38.4

[56] References Cited

U.S. PATENT DOCUMENTS 4,438,433 3/1984 Smoot et al. .
4,618,860 10/1986 Mori .
4,922,221 5/1990 Sato et al. .
4,949,085 8/1990 Fisch et al. .
4,959,648 9/1990 Breeden et al. .
4,988,991 1/1991 Motegi ..... 340/825.44
5,075,684 12/1991 DeLuca ..... 340/825.44
5,095,307 3/1992 Shimura et al. .
5,185,604 2/1993 Nepple et al. .
5,225,826 7/1993 DeLuca et al. .

OTHER PUBLICATIONS

Motorola; PMR 2000 Personal Message receiver; 1986.

*Primary Examiner*—Michael Horabik
*Attorney, Agent, or Firm*—Robert E. Bushnell

[57] ABSTRACT

A communication system using a pager receiving calling data transmitted via radio signals from a paging terminal, with the paging receiver being driven by a processing unit that decodes data in received calls and checks whether a first predetermined code has a request for precedence, and detects a corresponding mode by comparing a second predetermined code subsequent to the first predetermined code with predefined mode data, stores message data subsequent to the second predetermined code in a storage area of the detected corresponding mode, searches for repeatedly received message data by reading the message data stored, rearranges message data, and if a read key is depressed by a user, displays the message data component of the rearranged data.

34 Claims, 5 Drawing Sheets

URGENT CALL DISPLAYING METHOD FOR A RADIO PAGING RECEIVER

CROSS-REFERENCE TO RELATED APPLICATIONS

This application reference to, incorporates the same herein, and claims all benefits incurring under 35 U.S.C. §119 from an application for Urgent Call Displaying Method Of A Radio Paging Receiver filed in the Korea Industrial Property Office on 19 Nov. 1992 and assigned Serial No. 1992/21783.

BACKGROUND OF THE INVENTION

1. Technical Field

The present invention pertains to radio paging receivers, and more particularly, to a circuit and process for displaying indications of urgent calls with a radio paging receiver.

2. Background Art

Generally, a radio paging receiver such as a personal pager, is included in a one-way communication system (i.e., a radio paging system) capable of receiving a call provided by a caller. Currently available radio paging systems have a central paging terminal transmitting Post Office Code Standardization Advisory Group (i.e., POCSAG) coded radio signals to individual radio paging receivers or to groups of radio paging receivers via an antenna. A caller dialing the unique number assigned to a pager, is typically connected via public lines and a central office telephone switching system to the paging terminal. The paging terminal processes the unique number received via the public line from the caller, and transmits as a radio signal, a unique code also assigned to the pager sought by the caller.

The pager detects the transmission of its unique code, and as shown in U.S. Pat. No. 3,742,481 to Douglas W. Nickerson, stores incoming paging calls. Currently available pagers store as a received call, among other items, any message component of the radio signal received. Such received calls are stored in the order in which they are received by the pager and the person wearing the pager can, subsequent to the reception and storage of the call, confirm the reception of the call and read the message component of the call; if the pager has received a large number of calls however, the user will normally read all of the message components of the received calls. U.S. Pat. No. 4,438,433 for Multiaddress Pager With A Call Storage and Priority Paging Option to George W. Smoot, et al. endeavors to bypass the store-and-subsequent-read routine operation of pagers by using a decoder and shift register memory adapted to generate a priority status level signal when the incoming signal is an emergency call and a non-priority status level signal when the incoming signal is a non-emergency call, and to thereby effect an immediate reading of emergency-type signals. In some situations (e.g., a physician currently engaged in operating room surgery) however, effecting an immediate reading of a message upon reception of one, or worse, a succession, of emergency-type signals, does not concomitantly enable the person wearing the pager to either view or respond to the accompanying message.

U.S. Pat. No. 4,949,085 for Prioritization Of Stored Messages In A Digital Voice Paging Receiver to Kenneth D. Fisch, et al., envisions an embodiment of a pager storing messages in a predetermined priority, with replacement of one stored message by an incoming message when the priority status of the incoming message is greater than the priority status assigned to the memory slot in which the stored message is held (e.g., whether the stored message has a status designation of protect, unread, read or empty). In this scheme however, if all message slots within a queue contain stored messages, rather than risk the loss of an incoming message, the oldest message that has already been read, or alternatively, if no unread messages are stored, the oldest message (i.e., the message having the highest queue order) is deleted to accommodate storage of an incoming message with greater priority status. The chronological order of the undeleted messages within the queue is preserved however. Consequently, in this scheme the message component of an urgent call could be deleted even though never having been read by the wearer of the pager, if that message has the highest queue order, an occurrence which is not necessarily desired particularly when the pager receives a number of calls exceeding its storage capacity within a short interval.

The pager described in U.S. Pat. No. 5,225,826 for Variable Status Receiver to DeLuca et al, for example, uses a pager equipped with a real time clock, and transmits calls with three message status signals followed by three time signals and a message; the message, status and time signals provide a basis for establishing a default status for the message and for changing the status of the message with the passage of time. DeLuca '826 contemplates responding to calls received on the basis of its status, and accommodating storage of the message component of a newly received call by deleting previously stored messages on the basis of the current status associated with the stored message.

In such currently available pagers, and as taught by Fisch '085, the order of storage of messages within a queue is independent of the status of the message, with messages stored in a plurality of message slots within a memory, and visually display messages in chronological order from the most recently received message to the oldest message without regard to status of the message slots (unread versus read). Moreover, even if the same call has been repeatedly received, the user normally reads the same message stored for each occasion on which that call was received in order to view all of the message components of the other calls received and stored. Furthermore, even if the caller causes a call (i.e., an "urgent call") to be transmitted to the pager to inform the pager of a very urgent situation, that urgent call is processed for storage with the same equality as other, non-urgent calls. As a result, it can be difficult to alert the wearer of the pager to the urgent situation.

Generally then, pagers currently commercially available inconveniently store all calls received on a space available basis, albeit with deletion of either previously read messages or the oldest message within the queue to accommodate storage of incoming calls, despite repetition of some calls, in a queue arranged in chronological order, and visually display calls received in the order (e.g., typically, in chronological order) in which those calls have been received, and hinder the ability of the wearer of the pager to quickly read a message for an urgent call.

SUMMARY OF THE INVENTION

It is therefore, one object of the present invention to provide an improved radio paging system.

It is another object to provide an urgent call displaying method for a radio paging receiver which can inform the wearer of an urgent call.

It is yet another object to provide a circuit and process for arranging calls received to facilitate identification of the reception of urgent calls.

It is still another object to provide a circuit and process for rearranging calls received to advance the display of urgent calls.

It is still yet another object to provide a circuit and process enabling priority in the display of urgent calls.

It is a further object to provide a circuit and process for altering the order of the display of calls received.

It is a yet further object to provide a circuit and process for advancing display of urgent calls received ahead of repeated, non-urgent calls.

It is a still further object to provide a circuit and process to quickly display urgent calls received by a pager.

It is a still yet further object to provide a circuit and process enabling a caller to re-arrange the sequence of calls stored by the pager being called.

It is also an object to provide a circuit and process for storing a message on the basis of the status of that message.

These and other objects may be achieved with a communication system using a pager receiving calling data transmitted via radio signal from a paging terminal, with the paging receiver being driven by a processing unit that decodes data in received calls and checks whether a first predetermined code has a request for precedence, and detects a corresponding mode by comparing a second predetermined code subsequent to the first predetermined code with predefined mode data, stores message data subsequent to the second predetermined code in a storage area of the detected corresponding mode, searches for repeatedly received message data by reading the message data stored, rearranges message data, and if a read key is depressed by a user, displays the message data component of the rearranged data. Preferably, the processing unit sequentially accesses and processes a storage media in order to reduce hardware requirements necessary to implement the communication system.

It is contemplated that the process and circuit may be easily operated by the expedient of using a telephone deskset connected to a public telephone line to dial the unique number assigned to the pager to be called, and by then depressing the first and second predetermined codes and messages. The pager may be operated in an urgent call mode, a group call mode, and a repeated call mode.

The present invention is more specifically described in the following paragraphs by reference to the drawings attached only by way of example.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF CERTAIN PREFERRED EMBODIMENTS

Figure 1:
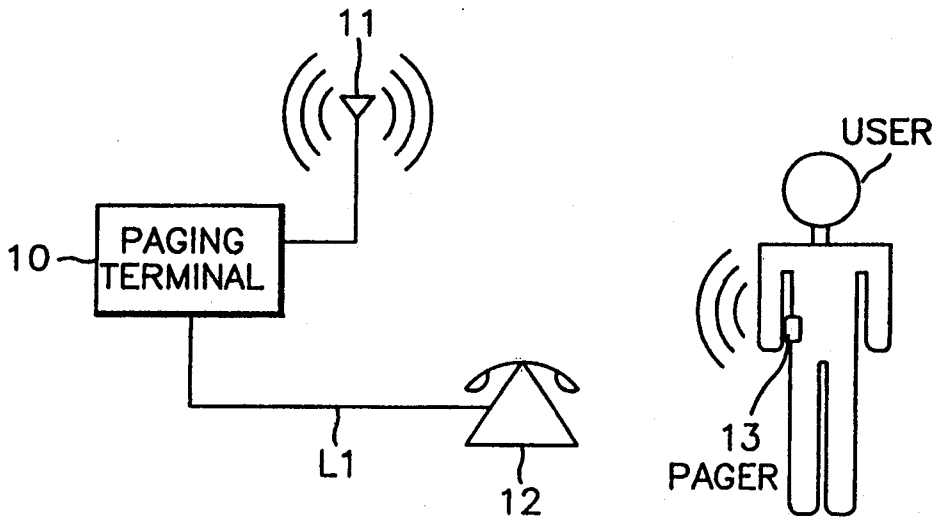
FIG. 1 is a block diagram of a radio paging system as incorporated into one embodiment of the present invention.

Referring now to the drawings and particularly to FIG. 1, the radio paging system includes a paging terminal 10 having at least a transmitter. The paging terminal 10 is connected to an antenna 11 and to a telephone apparatus 12 through a public line L1. A telephone switching system is usually coupled between the public line L1 and the telephone apparatus 12. A person desiring to call a user wearing a pager 13 can dial by use of telephone apparatus 12, an unique number assigned to pager 13. Paging terminal 10 processes the unique number received through a fixed wire telephone line L1 and sends a signal by radio waves through antenna 11. Therefore, when the unique number is received, pager 13 gives an alarm or displays messages. The POCSAG (Post Office Code Standardization Advisory Group) code is used as a radio signal sent through antenna 11. The POCSAG code is the exclusive signal form for paging receivers currently used in the world, and it is specified in CCIR Recommendation No. 584. The internal circuit block of pager 13 is conventional in the art.

Pager 13 has functions for detecting the reception of general calls, storing the calls in a memory and displaying it. Calls are stored in memory in received order and the user may confirm reception of sequentially stored calls. If there is a large number of received calls, the user should read all of the stored messages from the beginning up to the current time. Moreover, even if the same call is repeatedly received, the user must read the data repeatedly as the pager displays in chronological order or reception each message stored in the queue, and confirms the data from the start in order to see previously received calls. Furthermore, even if the caller transmits a call identifying a very urgent situation, the call is equally processed with general messages, and as a result, it is difficult to inform the user of the urgent situation.

Figure 2:
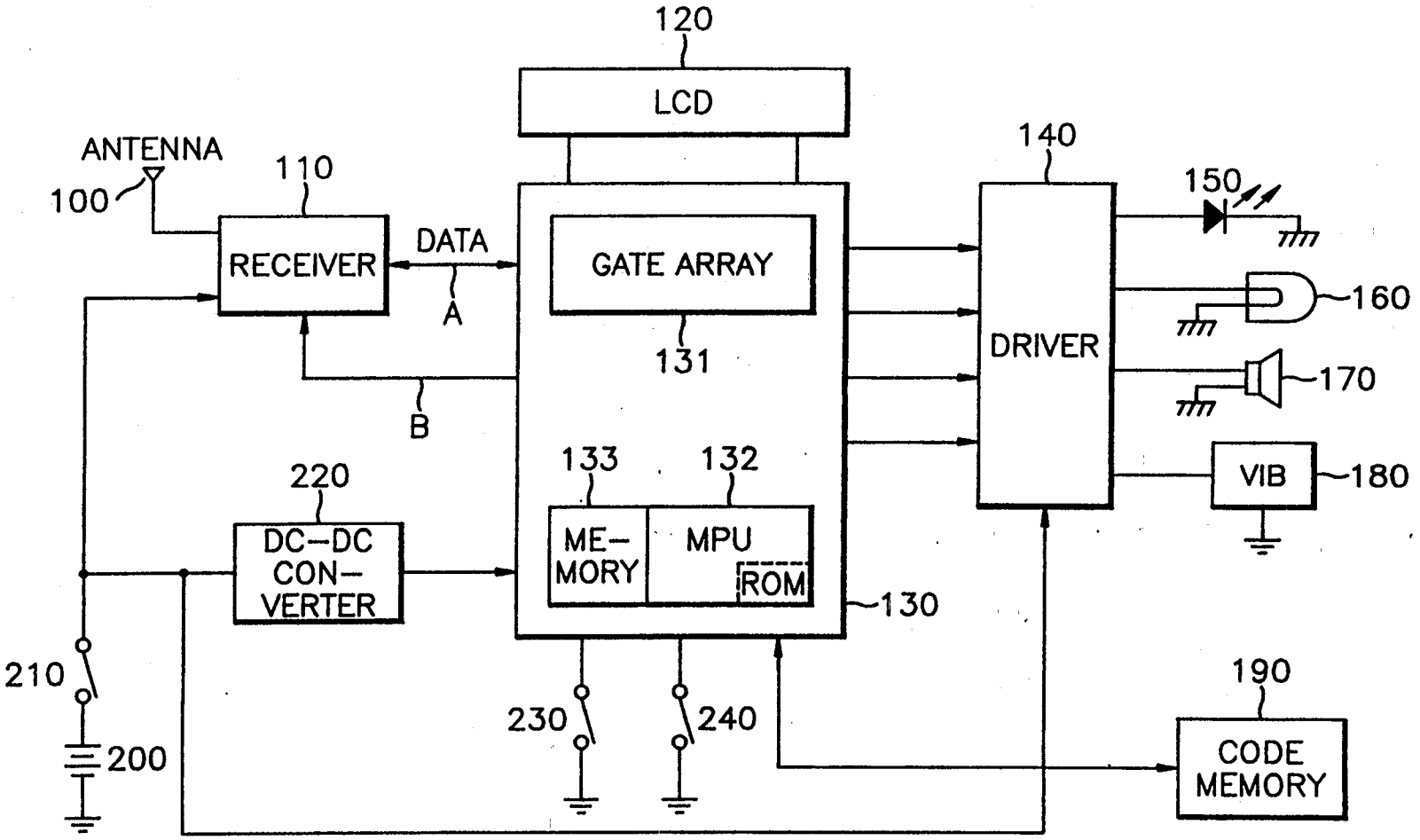
FIG. 2 is block diagram of a particular embodiment of a radio paging receiver constructed according to the principles of the present invention.

Referring now to FIG. 2, a modulated RF (radio frequency) signal provided by the paging terminal 10 shown in FIG. 1 is picked up by an antenna 100 connected to a receiver 110. The receiver 110 is periodically driven to thereby minimizing power consumption. In order to periodically drive the receiver 110, a decoder 130 provides a driving signal to receiver 110 through line B. When the driving signal is applied, receiver 110 demodulates the RF signal received from antenna 100 to generate logic level data through line A. Decoder 130 decodes the logic level data received through line A. In more detail, decoder 130 reads an identification (i.e., an "ID") address code stored in code memory 190 and checks whether or not the received calling data contains the unique address code of the pager and is therefore a call directed to the paging receiver (i.e. an "ID call") by comparing the ID address code with the logic level data. If the received calling data is identified as a call directed to the paging receiver (i.e. an "ID call"), decoder 130 decodes the successively received logic level data and stores the received messages in a memory 133. The stored messages are displayed on a liquid crystal display (LCD) 120. When the ID call is received, decoder 130 sends an alarm instruction to a driver 140. Driver 140 drives the alarm system including a speaker 170 for generating an alert tone, a vibrator 180 for providing a mechanical oscillation to the user, a call indicator 150 driven during the operating period of speaker 170, and a lamp 160 for back-lighting LCD 120. Decoder 130 is connected to external switches 230 and 240. Switch 230 is designated by the user so as to selectively drive speaker 170 or vibrator 180. Switch 240 is a read key for forcing speaker 170 or vibrator 180 to stop, or for recalling received messages stored in memory 133. A DC-DC converter 220 produces a power voltage for use in decoder 130 using a battery 200 which has a limited power capacity and is recharged. A switch 210 opens or closes the circuit with battery 200 to enable electrical power from battery 200 to be provided to the pager or, when switch 210 is opened, to interrupt supply of power to the pager.

Decoder 130 has a gate array 131, a micro processing unit (MPU) 132 and memory 133. Gate array 131 uses a plurality of gate elements for decoding the logic level data received via line A together with MPU 132. MPU 132, possibly a four-bit, one chip processor containing a read only memory (i.e., a "ROM"), performs the whole operation necessary for the reception of the radio call with a program contained in the ROM. A program (a control procedure shown in FIG. 3 is programmed using a programming language) configured according to the present invention may be stored in the ROM. Memory 133 may be a random access memory (i.e., a "RAM") and may have a structure with an internal area arranged as shown in FIG. 4.

An example of an urgent call displaying operation of the radio paging receiver having the structure so far illustrated will now be described. Referring again to FIG. 1, in order to call pager 13, the caller dials the number of the unique address code assigned to the pager to be called, first and second predetermined codes and messages, successively, by use of a telephone deskset 12 installed for example, in a household, an office or outdoors elsewhere. The first predetermined code uses function keys (for example, "*" and "#") and a dial key "0", and the second predetermined code uses keys "1" and "2". It is assumed that the dial key "1" is an urgent call mode and the dial key "2" is a group call mode. The messages utilize ten keys "0" to "9" capable of indicating a caller's telephone number. In order to check whether or not the first or second predetermined code is received, the radio paging receiver has storage areas within code memory 190 provided by an Electrically Erasable and Programmable Read Only Memory (i.e., an EEPROM) for instance. That is, the areas for confirming the first and second predetermined codes are additionally provided.

Further, as is the convention in the art, there is a Customer Administration Panel (i.e., a CAP) code area of the ID address code. Assuming that the caller's telephone number is 256-3532 and the call is an urgent situation, the caller dials an urgent call by successively depressing "*", "0", "1", "2", "5", "6", "3", "5", "3", "2". The keys "*" and "0" correspond to the first predetermined code, and the key "1" is the second predetermined code of the urgent call mode. The keys "2", "5", "6", "3", "5", "3", "2" correspond to the message component of the calling data. Similarly, the caller may indicate a group call by dialing the second predetermined code of "2". The group call means a mode of communication with persons belonging to a specific group. The telephone desk or handset apparatus used by the caller should be an electronic telephone apparatus capable of generating a dual tone multi-frequency (i.e., a DTMF) signal.

The call generated by the operation of the caller is applied to paging terminal 10 shown in FIG. 1. Paging terminal 10 encodes the call instead of a general paging call, and then formats the call to a predefined transmission form. Thereafter, paging terminal 10 sends the call by radio through antenna 11. Hence, MPU 132 of the radio paging receiver implements the steps of the control process stored in the ROM, sequentially, as is shown in FIGS. 3A and 3B.

Figure 3A:
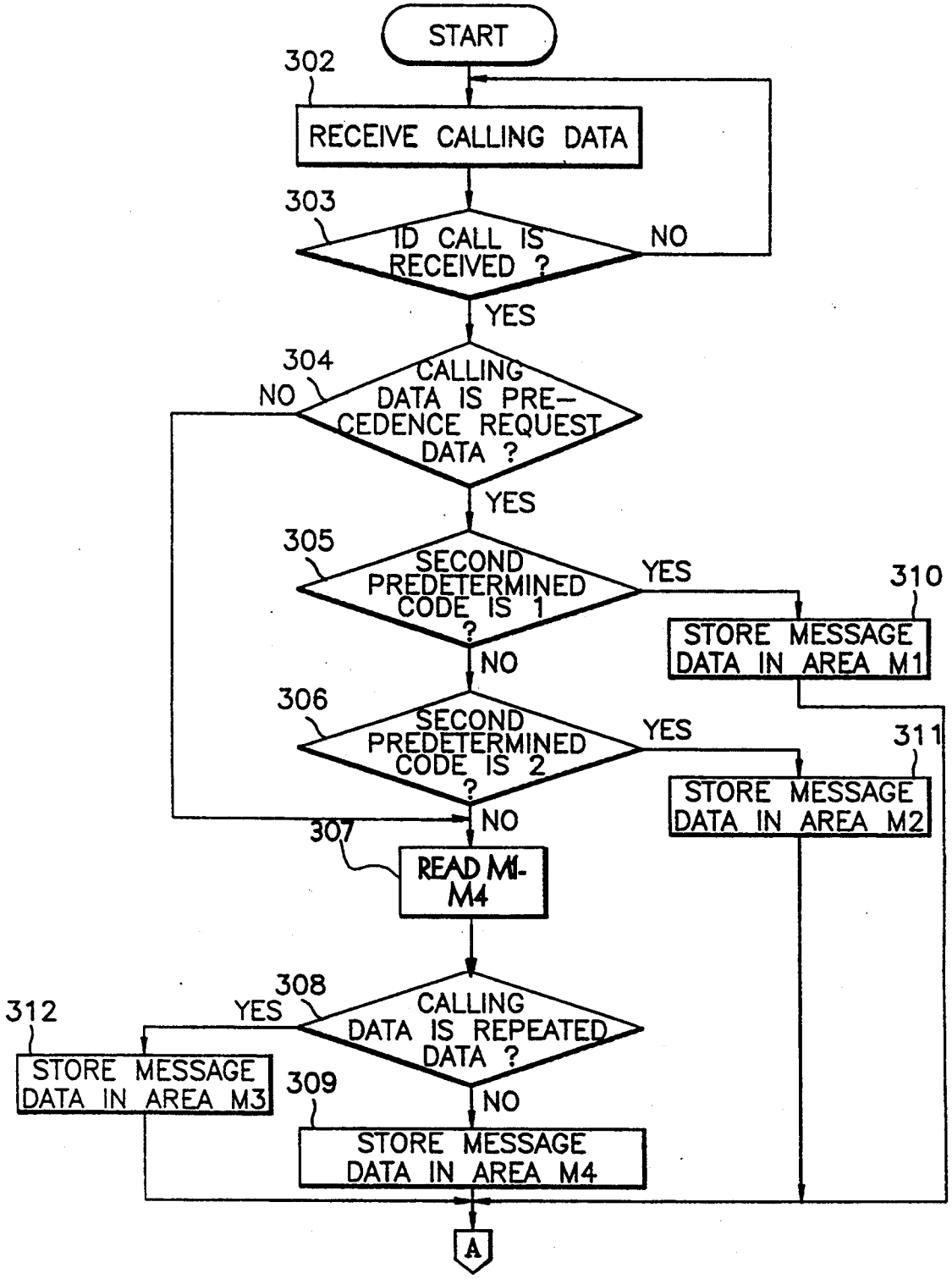
FIGS. 3A and 3B are flow charts showing an urgent call display procedure implemented according to the principles of present invention.
Figure 3B:
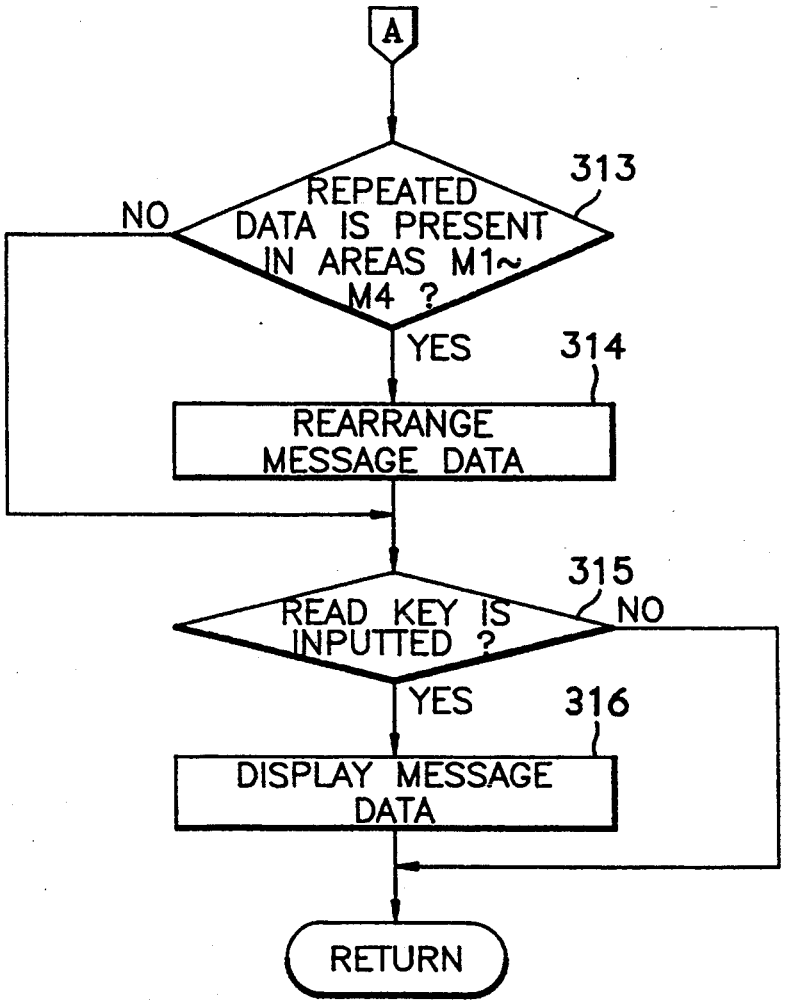
Figure 4:
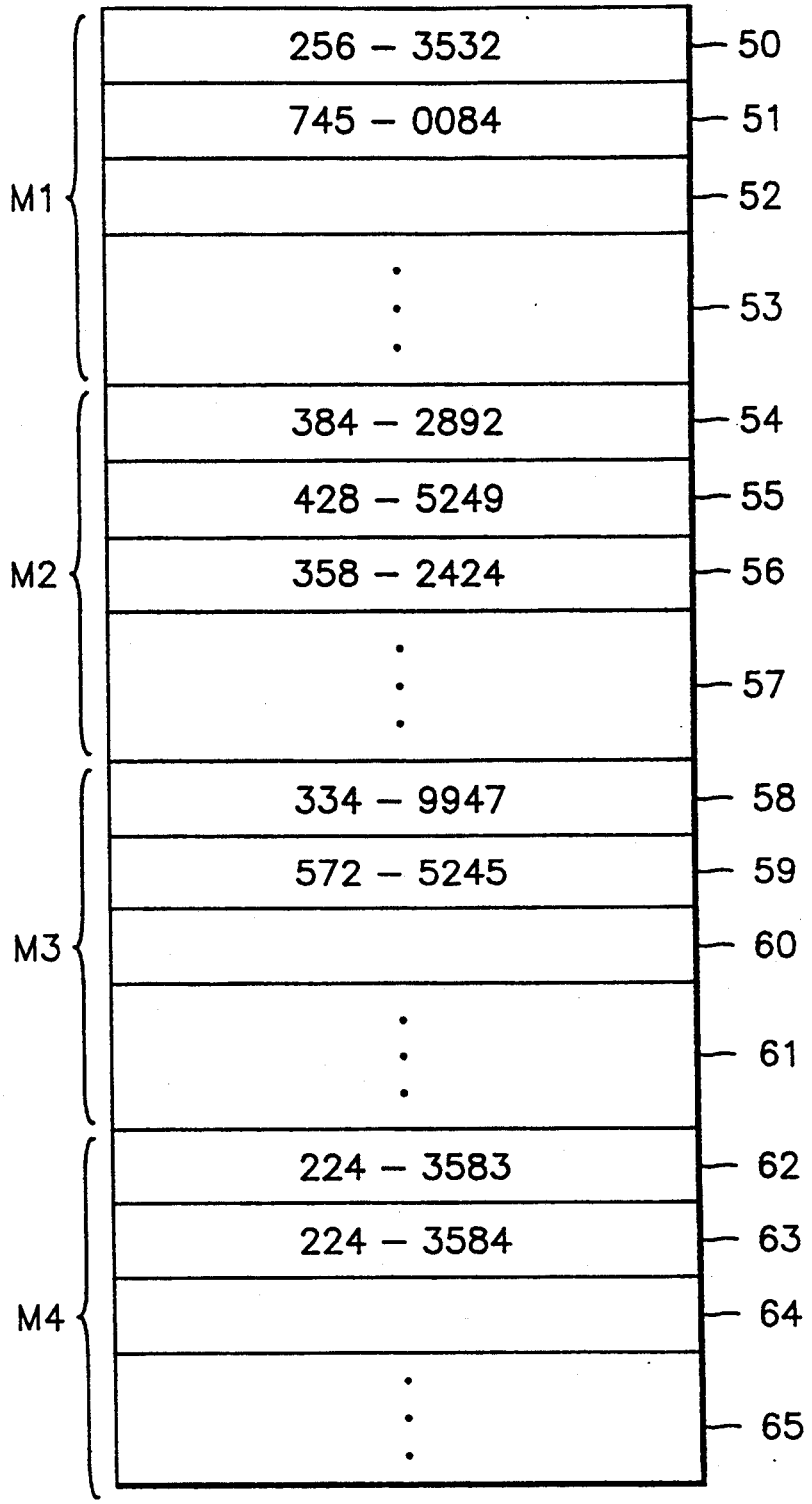
FIG. 4 is a diagram illustrating the storage state of a memory used according to the principles of the present invention.

Turning now to FIGS. 3A and 3B at step 302, a preamble signal transmitted from the paging terminal 10 is checked by periodically turning on and off receiver 110 with the dialing signal being periodically applied to line B. At step 303, a check is made to see if an ID call has been received. That is, if the preamble signal has been received, a synchronizing signal is detected and then whether the call received is an ID call or not is checked. When the caller dials the unique number of the corresponding pager accurately, step 303 proceeds to step 304 to detect the first predetermined code by decoding the calling data. If the first predetermined code of "*" and "0" is received as the calling data, the MPU 132 determines that the calling data is precedence request data. The precedence request data is determined by comparing the data corresponding to a first position of the calling data with the data of a corresponding area of code memory 190. It should be noted that the keys "*" and "0" are assumed, and any other keys may be used. Namely, in one preferred embodiment, the keys "*" and "0" are called the first predetermined code. If the calling data is determined by decoder 130 to be precedence request data, step 304 is succeeded by step 305 to determine whether or not a second position of the calling data, i.e., the second predetermined code, is "1" in order to determine the corresponding mode of the incoming call. Similarly, the corresponding mode is determined by comparing the data corresponding to the second position of the calling data with data of a corresponding area of the code memory 190. If the second predetermined code is "1", step 305 advances to step 310 to go into an urgent call mode. That is, an urgent call mode message data, which is subsequent to the second predetermined code, is stored in a first memory area M1 shown in FIG. 4.

If however, the second predetermined code is "2", decoder 130 proceeds from step 306 and advances to step 311 to implement a group call mode. In this case, the message data is stored in a second memory area M2. In step 307 the memory areas M1–M4 are read so that calling data, that is not precedence request data nor calling data with a second predetermined code, can be compared, in step 308, with the message data stored in memory areas M1–M4. At step 308, calling data without the first or second predetermined code (e.g., the message component of the incoming call) is checked to see if that calling data is a repeat of message data previously received. If it is a repeat of message data previously received, the message data of that calling data is stored in a third memory area M3, in step 312.

If it is determined that the calling data is not precedence request data (step 304), that the calling data does not have a second predetermined code (steps 305 and 306), that the calling data does not have previously been received and stored in any of memory areas M1–M4 (step 308), then the calling data is determined to comprise general message data and the general message data is stored in a fourth memory area M4 at step 309. Steps 310, 312, and 309 are followed by step 313. At step 313, MPU 132 checks whether or not there is data received repeatedly already stored in the respective memory areas M1 to M4. In step 313 the message data stored in each respective memory area M1–M4 is checked to determine whether there is any message data that has been repeatedly stored in that respective memory area. If data received repeatedly is found to be present, step 313 goes to step 314 to rearrange the stored data in order of the number of the repeated data. For example, if repeatedly received data is found in the first memory area M1, that data is shifted to be stored in third memory area M3 such that memory area M1 contains the first received message stored therein and the repeated message is stored in memory area M3. This ensures that the urgent data stored in memory area M1 remains stored in the chronological order received but there is no repeat of an earlier stored message. Then if repeatedly received data is found in second memory area M2, that data is shifted to be stored in third memory area M3 in a next storage location so that one copy of the message, i.e. the first group message, is stored in memory area M2 and a repeat of that message, if any, is stored in memory area M3. This process continues with the checking of memory area M3 and then M4, and if repeatedly received data is found in the fourth memory area M4, that repeatedly received data is shifted to the third memory area M3. The stored data has the priority for display indicated by the order shown in FIG. 4. At step 315, a read key is checked to see if it is depressed. If the user depresses read key 240, step 315 is followed by step 316 to display the message data stored in the memory areas M1 to M4 on the LCD 120 according to the order in which the message data is stored in memory 133. For example, data stored in section M1 will be read and usually displayed on LCD 120 in the order of message slot 50 followed by the message data stored in message slot 51. Therefore, the user is quickly enabled to read the sequentially displayed message data with urgent call message data being displayed first.

The control procedure shown in FIGS. 3A and 3B may be sufficiently programmed in the ROM with, for example, C programming language. C programming language is a compiler language with a compact program, and lends itself to easy correction of a program. Other languages may be applicable to the control procedure described here. A read-only memory may be used to store a routine for the processing unit while a random access memory may be used to store the message data of the calls received.

As may be apparent from the aforementioned description, the illustrated embodiment of the present invention may provide priority display of the urgent call in the radio paging receiver. Therefore advantages can be expected, such as the convenience of the user as well as improved radio paging service.

While preferred embodiments of the invention have been particularly shown and described, it will be understood by those skilled in the art that foregoing and other changes in form and details may be made without departing from the spirit and scope of the invention as defined in the appended claims and that it may be possible, for example, to define the first and second predetermined codes, by use of any other keys. Furthermore, the principles of the present invention are also directly applicable to mobile radio communication systems.

What is claimed is:

1. A communication system, comprising:

receiving means for receiving calling data transmitted via radio signal from a paging terminal;

a read key; and processing means for storing said calling data and for controlling said receiving means;

said processing means providing decoded data by decoding said calling data received by said receiving means;

said processing means determining whether a first code of the decoded data is a request for precedence;

said processing means detecting an operational mode by comparing a second code subsequent to said first code with predefined mode data when said first code is said request for precedence;

said processing means storing components of said calling data subsequent to said second code in storing means in dependence upon said operational mode;

said processing means determining whether calling data has been repeatedly received by reading said components of said calling data stored in said storing means to identify repeated data;

said processing means rearranging said components of said calling data into a re-arranged order in said storing means when it has been determined that repeated data has been received; and said processing means displaying said components in said re-arranged order in response to depression of said read key by a user.

2. The communication system of claim 1, further comprised of said processing means enabling display of said components of said calling data comprising said request for precedence, before display of said components of other calling data not comprising said request for precedence.

3. The communication system of claim 1, further comprised of said processing means giving precedence to calling data having a first code comprising said request for precedence, when storing said components of said calling data.

4. The communication system of claim 3, further comprised of said processing means storing message components of said calling data having said first code comprising said request for precedence in a queue enabling visual display before visual display of said message components of said calling data not having said first code comprising said request of precedence.

5. The communication system of claim 4, further comprised of said processing means storing message components of said calling data having said first code comprising said request for precedence in a queue in an order determined by said operational mode corresponding to said calling data having said first code comprising said request for precedence.

6. The communication system of claim 5, further comprised of said processing means storing message components of said calling data comprising said request for precedence within a first queue when said second code has a first value, and storing message components of said calling data comprising said request for precedence within a second queue when said second code has a second value.

7. The communication system of claim 5, further comprised of said processing means storing message components of said calling data comprising said request for precedence within a first queue when said second code has a first value, storing message components of said calling data comprising said request for precedence within a second queue when said second code has a second value, and storing message components of said calling data comprising no request for precedence within a third queue.

8. The communication system of claim 5, further comprised of said processing means, storing message components of said calling data comprising said request for precedence within a first queue when said second code has a first value, storing message components of said calling data comprising said request for precedence within a second queue when said second code has a second value, storing message components of said calling data comprising repeated data within a third queue, and storing message components of said calling data comprising no request for precedence and no repeated data in a fourth queue.

9. The communication system of claim 5, further comprised of said processing means, storing message components of said calling data comprising said request for precedence within a first queue when said second code has a first value, storing message components of said calling data comprising said request for precedence within a second queue when said second code has a second value, storing message components of said calling data comprising no request for precedence in a third queue, and rearranging said components of said calling data by storing a message component of said calling data stored within one of said first queue, said second queue and said third queue, in a fourth queue if said message component comprises said repeated data.

10. The communication system of claim 5, further comprised of said processing means, storing message components of said calling data comprising said request for precedence within a first queue when said second code has a first value, storing message components of said calling data comprising said request for precedence within a second queue when said second code has a second value, storing message components of said calling data comprising repeated data within a third queue, storing message components of said calling data comprising no request for precedence and no repeated data in a fourth queue, and rearranging said components of said calling data by storing a message component of said calling data stored within one of said first queue, said second queue, said third queue and said fourth, in said third queue when said message component comprises said repeated data.

11. The communication system of claim 1, further comprised of said processing means storing message components of said calling data received with an indication of precedence, in a queue enabling visual display in a sequence before visual display of message components of said calling data received without said indication of precedence.

12. The communication system of claim 11, further comprised of said processing means storing within said queue said calling data received with said indication of precedence, in an order depending upon said operational mode.

13. A communication system, comprising:

receiving means for receiving calling data transmitted via a radio signal from a paging terminal;

a read key; and processing means for storing said calling data and for controlling said receiving means;

said processing means providing decoded data by decoding said calling data received by said receiving means;

said processing means determining whether a first code of the decoded data is a request for precedence;

said processing means detecting an operational mode by comparing a second code subsequent to said first code with predefined mode data when said first code is said request for precedence; and said processing means storing components of said calling data subsequent to the second code in said storing means in dependence upon said operational mode.

14. The communication system of claim 13, further comprised of said processing means enabling display of said components of said calling data comprising said request for precedence, before display of said components of other calling data not comprising said request for precedence.

15. The communication system of claim 13, further comprised of said processing means giving precedence to calling data having said first code comprising said request for precedence, when storing said components of said calling data.

16. The communication system of claim 15, further comprised of said processing means storing message components of said calling data having said first code comprising said request for precedence in a queue enabling visual display before visual display of message components of said calling data not having said first code comprising said request of precedence.

17. The communication system of claim 16, further comprised of said processing means storing message components of said calling data having said first code comprising said request for precedence in a queue in an order determined by said operational mode corresponding to said calling data having said first code comprising said request for precedence.

18. The communication system of claim 17, further comprised of said processing means storing message components of said calling data comprising said request for precedence within a first queue when said second code has a first value, and storing message components of said calling data comprising said request for precedence within a second queue when said second code has a second value.

19. The communication system of claim 17, further comprised of said processing means storing message components of said calling data comprising said request for precedence within a first queue when said second code has a first value, storing message components of said calling data comprising said request for precedence within a second queue when said second code has a second value, and storing message components of said calling data comprising no request for precedence within a third queue.

20. The communication system of claim 17, further comprised of said processing means storing message components of said calling data comprising said request for precedence within a first queue when said second code has a first value, storing message components of said calling data comprising said request for precedence within a second queue when said second code has a second value, storing message components of said calling data comprising repeated data within a third queue, and storing message components of said calling data comprising no request for precedence and no repeated data in a fourth queue.

21. The communication system of claim 17, further comprised of said processing means storing message components of said calling data comprising said request for precedence within a first queue when said second code has a first value, storing message components of said calling data comprising said request for precedence within a second queue when said second code has a second value, storing message components of said calling data comprising no request for precedence in a third queue, and rearranging said components of said calling data by storing a message component of said calling data stored within one of said first queue, said second queue and said third queue, in a fourth queue when said message component comprises said repeated data.

22. The communication system of claim 17, further comprised of said processing means storing message components of said calling data comprising said request for precedence within a first queue when said second code has a first value, storing message components of said calling data comprising said request for precedence within a second queue when said second code has a second value, storing message components of said calling data comprising repeated data within a third queue, storing message components of said calling data comprising no request for precedence and no repeated data in a fourth queue, and rearranging said components of said calling data by storing a message component of said calling data stored within one of said first queue, said second queue and said fourth queue, in said third queue when said message component comprises said repeated data.

23. A communication system, comprising:

receiving means for receiving calling data transmitted via radio signal from a paging terminal;

processing means for storing said calling data and for controlling said receiving means; and a read key;

said processing means providing decoded data by decoding said calling data received by said receiving means;

said processing means determining whether a first code of the decoded data is a request for precedence;

said processing means when said first code is said request for precedence, detecting an operational mode by comparing a second code subsequent to said first code with predefined mode data;

said processing means storing components of said calling data subsequent to the second in said storing means;

said processing means determining whether calling data has been repeatedly received by reading said components of said calling data stored in said storing means to identify repeated data; and said processing means when said repeated data is identified, rearranging said components of said calling data into a re-arranged order, and when said read key is depressed by a user, displaying said called data in said re-arranged order.

24. The communication system of claim 23, further comprised of said processing means enabling display of said components of said calling data comprising said request for precedence, before display of said components of other calling data not comprising said request for precedence.

25. The communication system of claim 23, further comprised of said processing means giving precedence to calling data having a first code comprising said request for precedence, when storing said components of said calling data.

26. The communication system of claim 25, further comprised of said processing means storing message components of said calling data having a first code comprising said request for precedence in a queue enabling visual display before visual display of message components of said calling data not having a first code comprising said request of precedence.

27. The communication system of claim 26, further comprised of said processing means storing message components of said calling data having said first code comprising said request for precedence in a queue in an order determined by said operational mode corresponding to said calling data having said first code comprising said request for precedence.

28. The communication system of claim 27, further comprised of said processing means storing message components of said calling data comprising said request for precedence within a first queue when said second code has a first value, and storing message components of said calling data comprising said request for precedence within a second queue when said second code has a second value.

29. The communication system of claim 27, further comprised of said processing means storing message components of said calling data comprising said request for precedence within a first queue when said second code has a first value storing message components of said calling data comprising said request for precedence within a second queue when said second code has a second value, and storing message components of said calling data comprising no request for precedence within a third queue.

30. The communication system of claim 27, further comprised of said processing means storing message components of said calling data comprising said request for precedence within a first queue when said second code has a first value, storing message components of said calling data comprising said request for precedence within a second queue when said second code has a second value, storing message components of said calling data comprising repeated data within a third queue, and storing message components of said calling data comprising no request for precedence and no repeated data in a fourth queue.

31. The communication system of claim 27, further comprised of said processing means storing message components of said calling data comprising said request for precedence within a first queue when said second code has a first value, storing message components of said calling data comprising said request for precedence within a second queue when said second code has a second value, storing message components of said calling data comprising no request for precedence in a third queue, and performing said rearranging of said components of said calling data by storing a message component of said calling data stored within one of said first queue, said second queue and said third queue, in a fourth queue when said message component comprises said repeated data.

32. The communication system of claim 27, further comprised of said processing means storing message components of said calling data comprising said request for precedence within a first queue when said second code has a first value, storing message components of said calling data comprising said request for precedence within a second queue when said second code has a second value, storing message components of said calling data comprising repeated data within a third queue storing message components of said calling data comprising no request for precedence and no repeated data in a fourth queue and performing said rearranging of said components of said calling data by storing a message component of said calling data stored within one of said first queue, said second queue said third queue and said fourth queue, in said third queue when said message component comprises said repeated data.

33. The communication system of claim 23, further comprised of said processing means storing within said queue said calling data received with an indication of precedence, in a queue enabling visual display in a sequence before visual display of message components of said calling data received without an indication of precedence.

34. The communication system of claim 33, further comprised of said processing means storing within said queue said calling data received from an indication of precedence, in an order depending upon said operational mode.

* * * * *